US009504873B2

(12) United States Patent
Yeh

(10) Patent No.: US 9,504,873 B2
(45) Date of Patent: Nov. 29, 2016

(54) REHABILITATION EQUIPMENT

(71) Applicant: PREVENTIVE MEDICAL HEALTH CARE CO., LTD., Taoyuan County (TW)

(72) Inventor: Ching-Yu Yeh, Taichung (TW)

(73) Assignee: PREVENTIVE MEDICAL HEALTH CARE CO., LTD., Taoyuan (TW)

( * ) Notice: Subject to any disclaimer, the term of this patent is extended or adjusted under 35 U.S.C. 154(b) by 6 days.

(21) Appl. No.: 14/599,552

(22) Filed: Jan. 19, 2015

(65) Prior Publication Data

US 2016/0001126 A1 Jan. 7, 2016

(30) Foreign Application Priority Data

Jul. 2, 2014 (TW) ..... 103211748 U

(51) Int. Cl.

| | |
|---|---|
| ***A63B 21/00*** | (2006.01) |
| ***A63B 21/008*** | (2006.01) |
| ***A63B 23/035*** | (2006.01) |
| ***A63B 23/12*** | (2006.01) |

(52) U.S. Cl.

CPC ..... *A63B 23/1263* (2013.01); *A63B 21/008* (2013.01); *A63B 21/00069* (2013.01); *A63B 21/0087* (2013.01); *A63B 21/00192* (2013.01); *A63B 21/4035* (2015.10); *A63B 21/4047* (2015.10); *A63B 23/03533* (2013.01); *A63B 2208/0233* (2013.01)

(58) Field of Classification Search

CPC ..... A63B 21/4033; A63B 21/4035; A63B 21/4045–21/4049; A63B 22/0002–22/0005; A63B 23/1245–23/1272; A63B 69/10; A63B 23/03516; A63B 23/03533

See application file for complete search history.

(56) References Cited

U.S. PATENT DOCUMENTS

| | | | | | |
|---|---|---|---|---|---|
| 4,477,071 | A * | 10/1984 | Brown | A63B 22/0076 | 482/112 |
| 4,872,668 | A * | 10/1989 | McGillis | A63B 21/0083 | 434/254 |
| 5,282,748 | A * | 2/1994 | Little | A63B 69/10 | 434/254 |
| 5,743,832 | A * | 4/1998 | Sands | A63B 22/001 | 482/112 |
| 2009/0108648 | A1* | 4/2009 | Biggs | A63B 21/0552 | 297/217.1 |
| 2009/0118106 | A1* | 5/2009 | Leisenring | A63B 23/03516 | 482/121 |
| 2010/0062906 | A1* | 3/2010 | Abelbeck | A63B 23/1209 | 482/51 |

* cited by examiner

*Primary Examiner* — Oren Ginsberg
*Assistant Examiner* — Jennifer M Deichl
(74) *Attorney, Agent, or Firm* — CKC & Partners Co., Ltd.

(57) ABSTRACT

A rehabilitation equipment includes a main frame, a rotating mechanism, a linking mechanism and a resistance mechanism. The rotating mechanism is disposed on the main frame. The linking mechanism is linked up with the rotating mechanism. The resistance mechanism is for providing a resistance.

20 Claims, 10 Drawing Sheets

REHABILITATION EQUIPMENT

RELATED APPLICATIONS

This application claims priority to Taiwan Application Serial Number 103211748, filed Jul. 2, 2014, which is herein incorporated by reference.

BACKGROUND

Technical Field

The present disclosure relates to a rehabilitation equipment.

Description of Related Art

For many injured people, recovery of the limb function has to rely on rehabilitation campaign. With the medical progress and popularity of rehabilitation, wide range of rehabilitation equipment has developed, which is corresponding to a variety of specific needs of patients, and can train the specific muscle groups or specific limb coordination for recovering limb function.

The conventional arm rehabilitation has handles linked up with the chain and the gears for providing a reciprocal motion and generating an adjustable resistance. However, the chain and the gears would easily generate the damage and noise, so that the lifetime of the arm rehabilitation would be shorten, and the patient would resist to using the arm rehabilitation.

Further, for extending the lifetime of the arm rehabilitation, the cost for maintain the arm rehabilitation, such as replacement of the components, would be increased. Moreover, the structure of the conventional arm rehabilitation is complex, so that the probability of breakdown would be higher.

SUMMARY

According to an aspect of the present disclosure, a rehabilitation equipment includes a main frame, a rotating mechanism, a linking mechanism and a resistance mechanism. The rotating mechanism is disposed on the main frame. The linking mechanism is linked up with the rotating mechanism. The resistance mechanism is for providing a resistance. The rotating mechanism includes a first rotating arm and a second rotating arm, wherein the first rotating arm and the second rotating arm are pivotally connected to two sides of the main frame, respectively. The linking mechanism includes a first linking member, a second linking member and the third linking member. The first linking member is linked up with the first rotating arm, the second linking member is linked up with the second rotating arm, wherein the first linking member and the second linking member are reciprocally and reversely linked up to each other. The third linking member is pivotally connected to the main frame, and has a first region and a second region, wherein the first linking member is pivotally connected to the first region, the second linking member is pivotally connected to the second region, thus the third linking member is reciprocally swung by the first linking member and the second linking member. The resistance mechanism includes a first resistance member and a second resistance member, wherein one end of the first resistance member and one end of the second resistance member are pivotally connected to the main frame respectively, and the other end of the first resistance member and the other end of the second resistance member are pivotally connected to the first region and the second region of the third linking member respectively.

According to another aspect of the present disclosure, a rehabilitation equipment includes a main frame, a first rotating arm, a second rotating arm, a first pivoting unit, a second pivoting unit, a first linking member, a second linking member, a third linking member, a first resistance member, a second resistance member and a seat. The first pivoting unit is for pivotally connecting the first rotating arm to one side of the main frame. The second pivoting unit is for pivotally connecting the second rotating arm to the other side of the main frame. The first linking member is connected to the first pivoting unit for linking up with the first rotating arm. The second linking member is connected to the second pivoting unit for linking up with the second rotating arm, wherein the first linking member and the second linking member are reciprocally and reversely linked up to each other. The third linking member is pivotally connected to the main frame, and has a first region and a second region, wherein the first linking member is pivotally connected to the first region, the second linking member is pivotally connected to the second region, thus the third linking member is reciprocally swung by the first linking member and the second linking member. One end of the first resistance member is connected to the main frame, the other end of the first resistance member is pivotally connected to the first region of the third linking member. One end of the second resistance member is connected to the main frame, the other end of the second resistance member is pivotally connected to the second region of the third linking member. The seat is rotatably disposed on the main frame.

DETAILED DESCRIPTION

Figure 1:
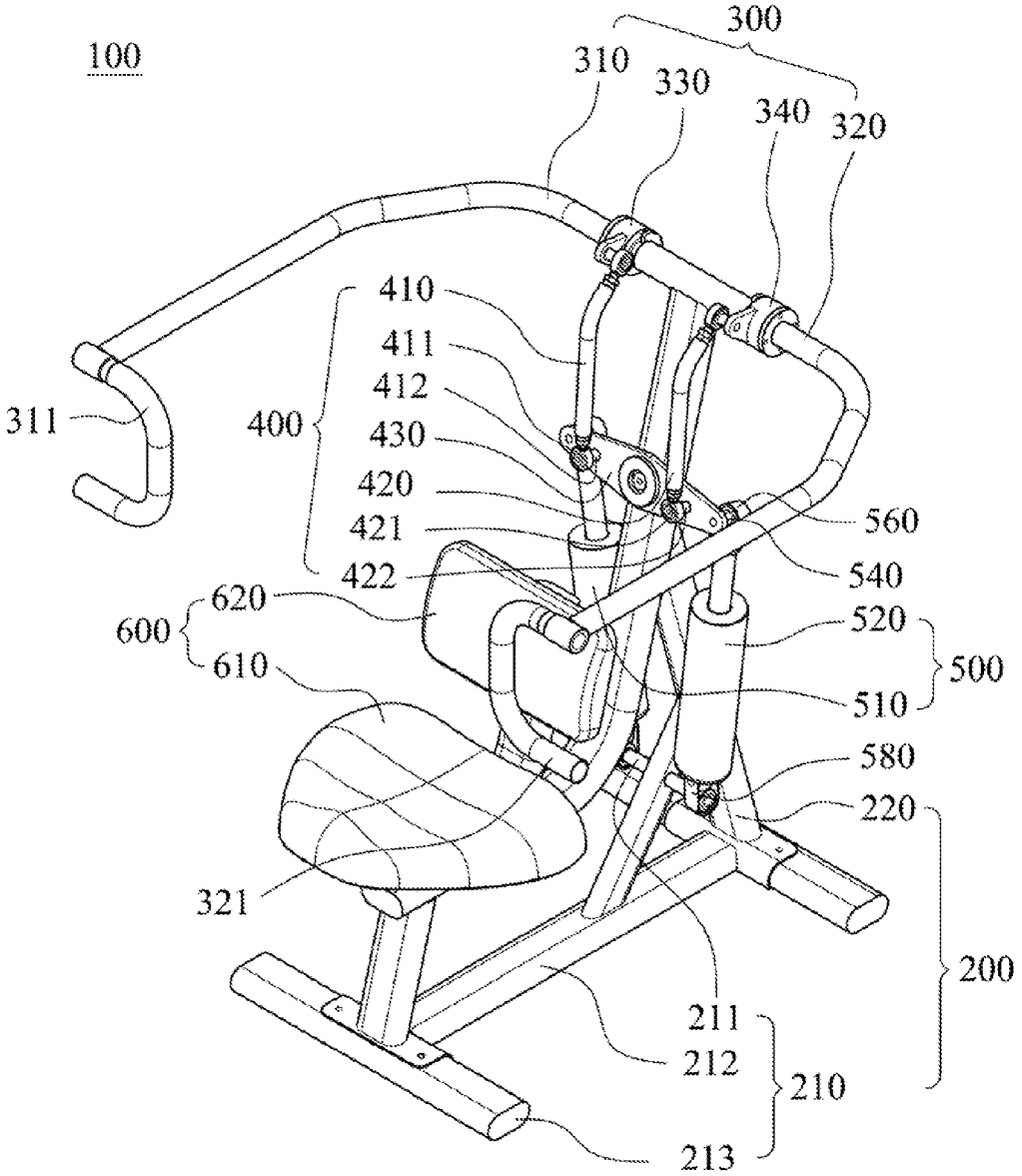
FIG. 1 shows a three-dimensional view of a rehabilitation equipment according to an embodiment of the present disclosure.

FIG. 1 shows a three-dimensional view of a rehabilitation equipment 100 according to an embodiment of the present disclosure. The rehabilitation equipment 100 includes a main frame 200, a rotating mechanism 300, a linking mechanism 400, a resistance mechanism 500 and a seat 600. The rotating mechanism 300 is disposed on the main frame 200. The linking mechanism 400 is linked up with the rotating mechanism 300. The resistance mechanism 500 is for providing a resistance. The seat 600 is disposed on the main frame 200.

In detail, the main frame 200 includes a base frame 210 and a supporting frame 220, wherein the base frame 210 is for placing on the ground, and the supporting frame 220 is vertically disposed on the base frame 210. The base frame 210 can include a cross frame shaft 211, a connecting frame shaft 212 and a front frame shaft 213, wherein the connecting frame shaft 212 connects the cross frame shaft 211 and the front frame shaft 213, so that the base frame 210 can be arranged into l-shaped. Therefore, the rehabilitation equipment 100 can be places on the ground stably, and would not be shaken during using.

Figure 2:
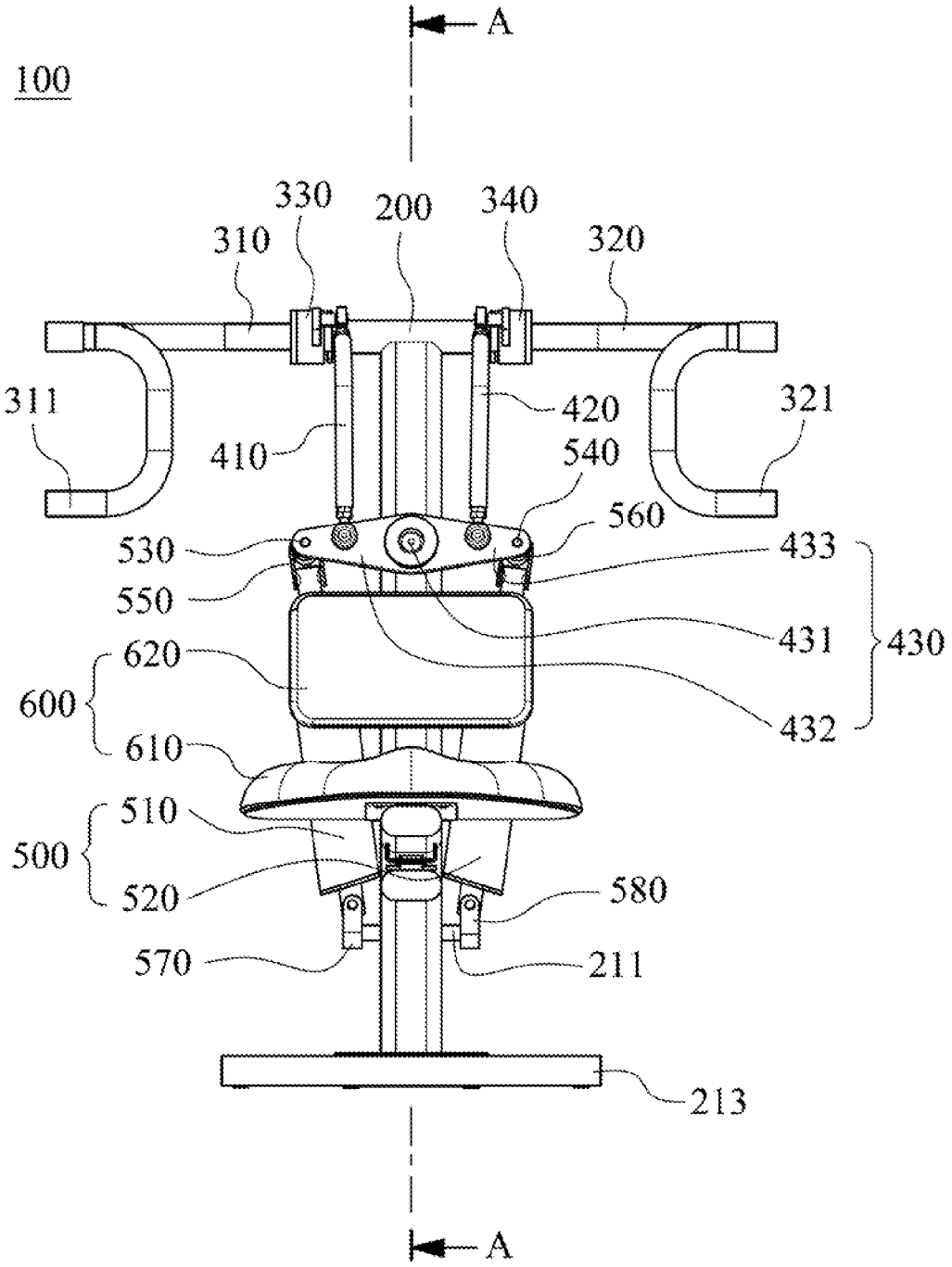
FIG. 2 shows a front view of the rehabilitation equipment of FIG. 1.

The rotating mechanism 300 is pivotally connected to the main frame 200, and includes a first rotating arm 310 and a second rotating arm 320. FIG. 2 shows a front view of the rehabilitation equipment 100 of FIG. 1. In FIG. 2, one end of the first rotating arm 310 and one end of the second rotating arm 320 are symmetrically and pivotally connected to two sides of the supporting frame 220 of the main frame 200, respectively. Each of the other end of the first rotating arm 310 and the other end of the second rotating arm 320 is connected to each of two handles 311, 321, respectively, wherein the handles 311, 321 are bending shape. Therefore, the holding posture of the user is comfortable for reciprocally driving the first rotating arm 310 and the second rotating arm 320, and can avoid injury by improper holding posture.

The linking mechanism 400 is linked up with the rotating mechanism 300, and includes a first linking member 410, a second linking member 420 and a third linking member 430. The first linking member 410 is linked up with the first rotating arm 310. The second linking member 420 is linked up with the second rotating arm 320, wherein the first linking member 410 and the second linking member 420 are reciprocally and reversely linked up to each other. The third linking member 430 is reciprocally swung by the first linking member 410 and the second linking member 420. In detail, the third linking member 430 is pivotally connected to the main frame 200, and can include a central connecting axis 431 for pivotally connecting a center of the third linking member 430 to the supporting frame 220 of the main frame 200, so that the third linking member 430 can be pivoted stably. The third linking member 430 has a first region 432 and the second region 433, wherein the first linking member 410 is pivotally connected to the first region 432, the second linking member 420 is pivotally connected to the second region 433. When the first linking member 410 and the second linking member 420 are linked up with the first rotating arm 410 and the second rotating arm 420, respectively, the third linking member 430 is reciprocally swung by the first linking member 410 and the second linking member 420.

The resistance mechanism 500 provides a resistance by a telescopic motion, and includes a first resistance member 510 and a second resistance member 520, which are pivotally connected to the main frame 200, respectively. One end of the first resistance member 510 and one end of the second resistance member 520 are pivotally connected to the cross frame shaft 211 of the main frame 200, respectively. The other end of the first resistance member 510 and the other end of the second resistance member 520 are pivotally connected to the first region 432 and the second region 433 of the third linking member 430, respectively. According to the embodiment of FIG. 1, the first resistance member 510 and the second resistance member 520 are pneumatic cylinders. The first resistance member 510 and the second resistance member 520 can be oil cylinders, or magnetic resistance mechanism, but not limited thereto.

Further, for stably pivoting the first rotating arm 310 and the second rotating arm 320 of the rotating mechanism 300, and then linking up with the first linking member 410 and the second linking member 420, the rehabilitation equipment 100 can further include a first pivoting unit 330 and the second pivoting unit 340, which are for pivotally connecting the first rotating arm 310 and the second rotating arm 320 to two sides of the main frame 200, respectively, and the first linking member 410 and the second linking member 420 can be connected to the first pivoting unit 330 and the second pivoting unit 340, respectively. Therefore, the first rotating arm 310 and the second rotating arm 320 can be pivoted smoothly, and the first linking member 410 and the second linking member 420 can be linked up stably.

The seat 600 is rotatably disposed on the main frame 200. When the user holds the handles 311, 321 and reciprocally pivots the first rotating arm 310 and the second rotating arm 320, the body can also swing and then moving the seat 600. Therefore, the injury during using can be avoided. Furthermore, the seat 600 can include a seat cushion 610 and a back cushion 620. Therefore, when the user sits on the seat cushion 610 for using the rehabilitation equipment 100, the back cushion 620 can support the user's back for maintaining the correct posture, so that the rehabilitation can be achieved, and the injury can be avoided. Moreover, the height of the seat cushion 610 of the seat 600 can be adjusted, so that the rehabilitation equipment is suitable for varied figure.

Figure 3:
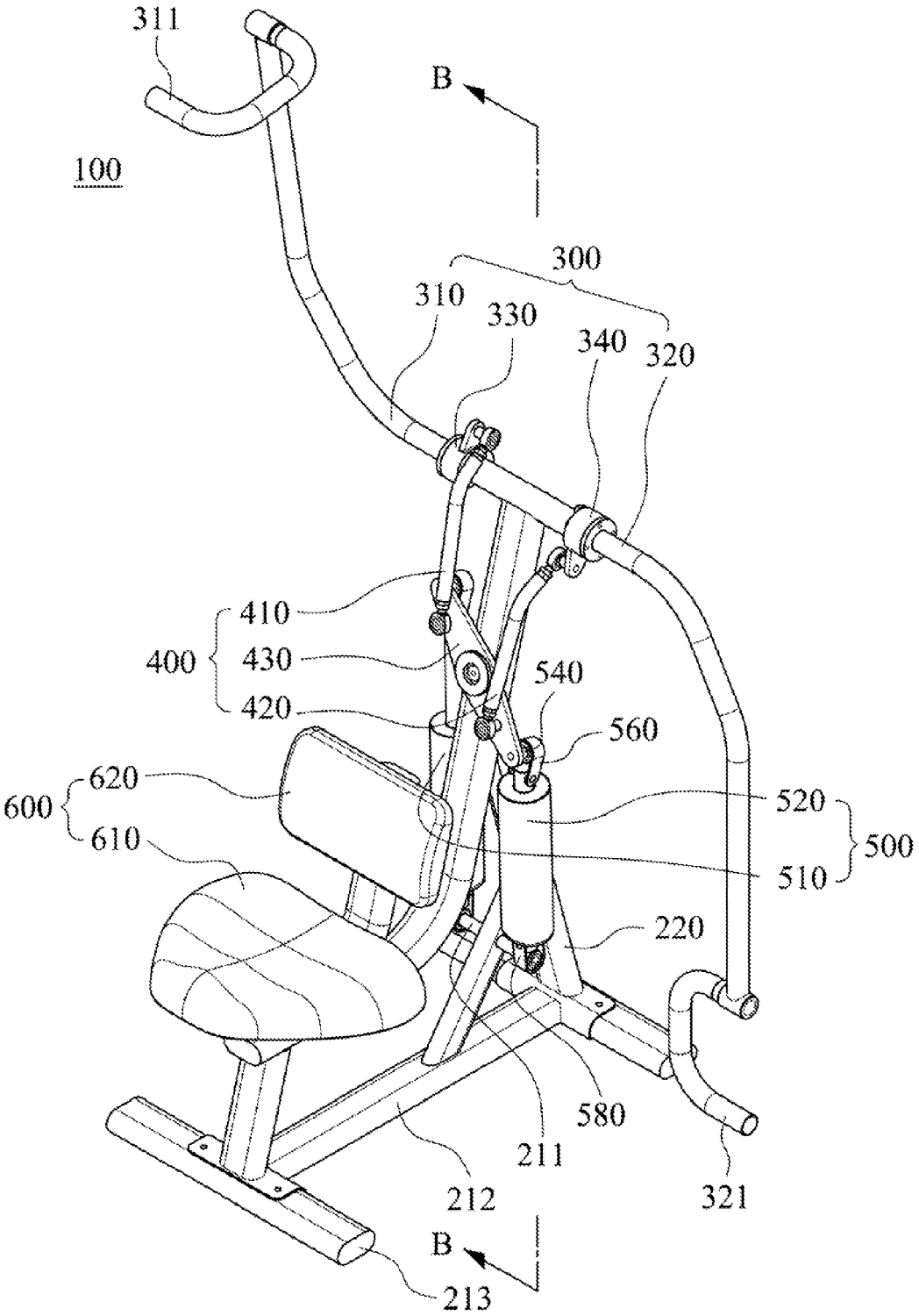
FIG. 3 shows a three-dimensional view of one using state of the rehabilitation equipment of FIG. 1.

FIG. 3 shows a three-dimensional view of one using state of the rehabilitation equipment 100 of FIG. 1. In FIG. 3, when the first rotating arm 310 is rotated upward and links up with the first linking member 410, the third linking member 430 can be linked up with the first linking member 410. A center of the third linking member 430 is pivotally connected to the main frame 200 via the central connecting axis 431, so that when the first linking member 410 links up with the first region 432 of the third linking member 430 for swinging upward, the second region 433 can be swung downward and links up with the second linking member 420 which is connected to the second region 433 of the third linking member 430, and then the second rotating arm 320 can be rotated downward.

Figure 4:
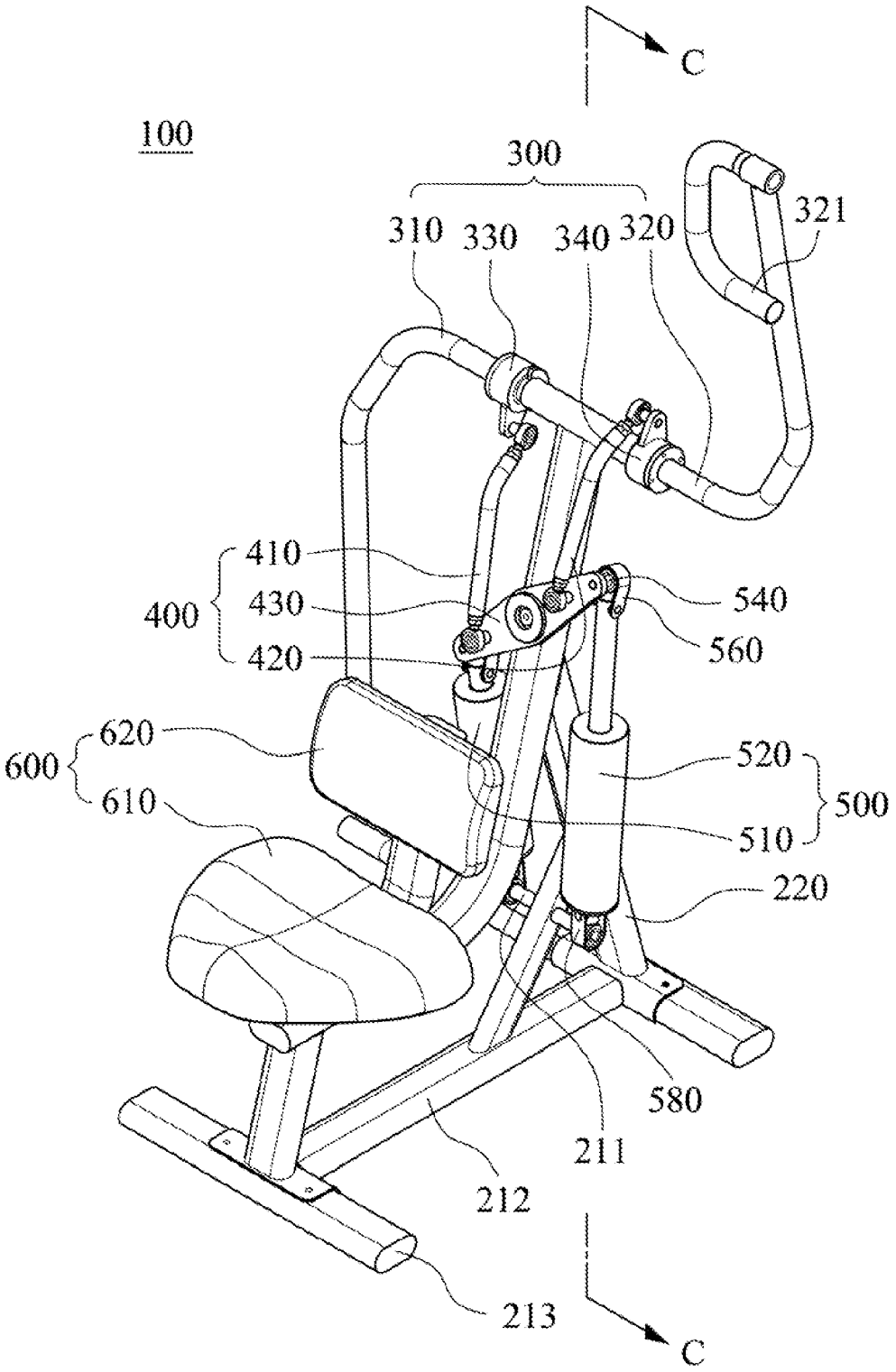
FIG. 4 shows a three-dimensional view of another using state of the rehabilitation equipment of FIG. 1.

FIG. 4 shows a three-dimensional view of another using state of the rehabilitation equipment 100 of FIG. 1. In FIG. 4, when the first rotating arm 310 is rotated downward and links up with the first linking member 410, the third linking member 430 can be linked up and pivoted, at the time, the third linking member 430 can link up with the second linking member 420 upward, and the second rotating arm 320 can be swung upward.

The reverse rotation of the first linking member 410 and the second linking member 420 is provided via the pivot of the third linking member 430, so that the first rotating arm 310 and the second rotating arm 320 of the rotating mechanism 300 can be rotated reversely. When the third linking member 430 is pivoted and swung reciprocally, the first resistance member 510 and the second resistance member 520 can be forced for telescopically moving and providing the resistance. Hence, the rotating speed of the first rotating arm 310 and the second rotating arm 320 can be restricted for achieving the purpose of rehabilitation.

Figure 5A:
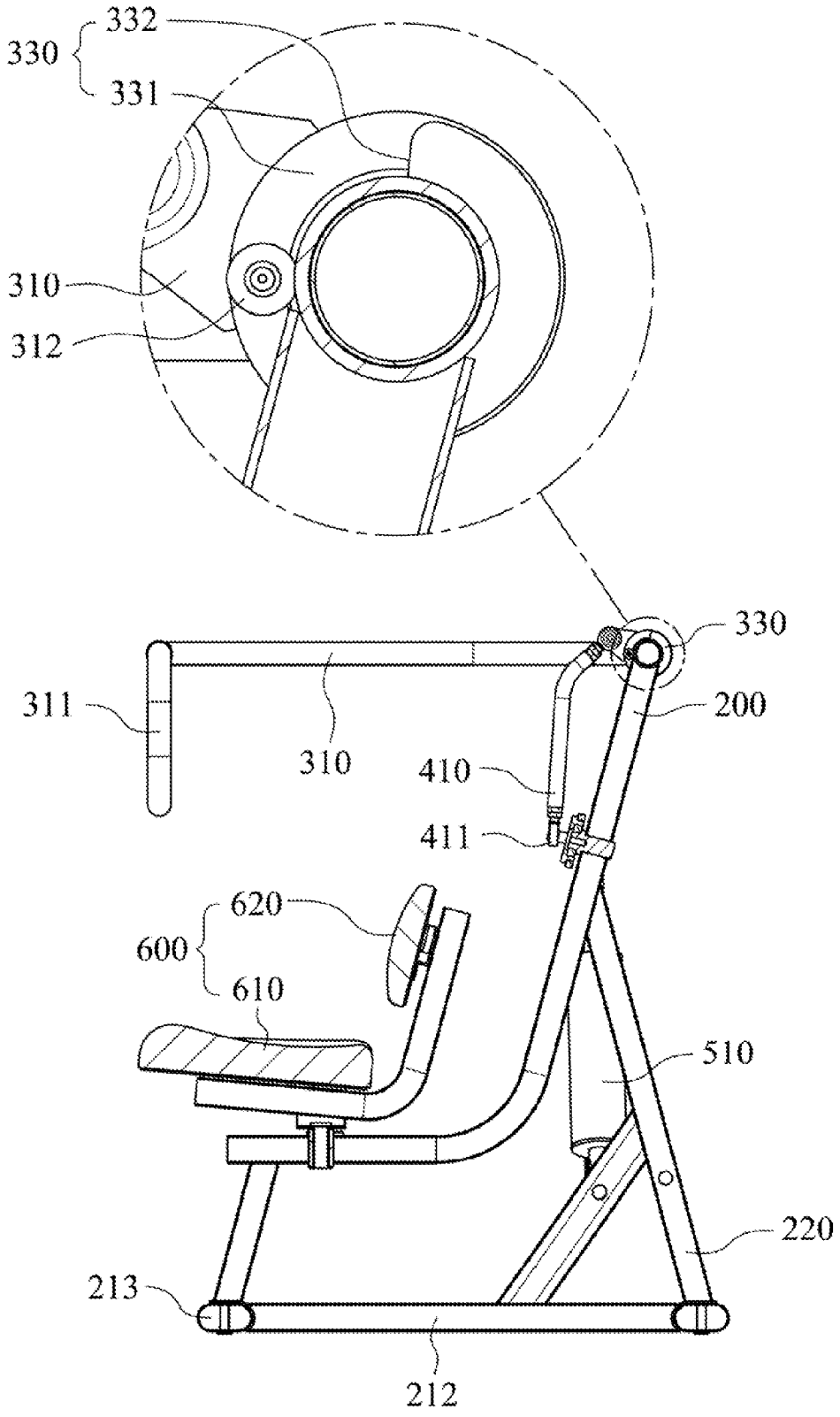
FIG. 5A shows a cross-sectional view along line A-A of FIG. 2.
Figure 5B:
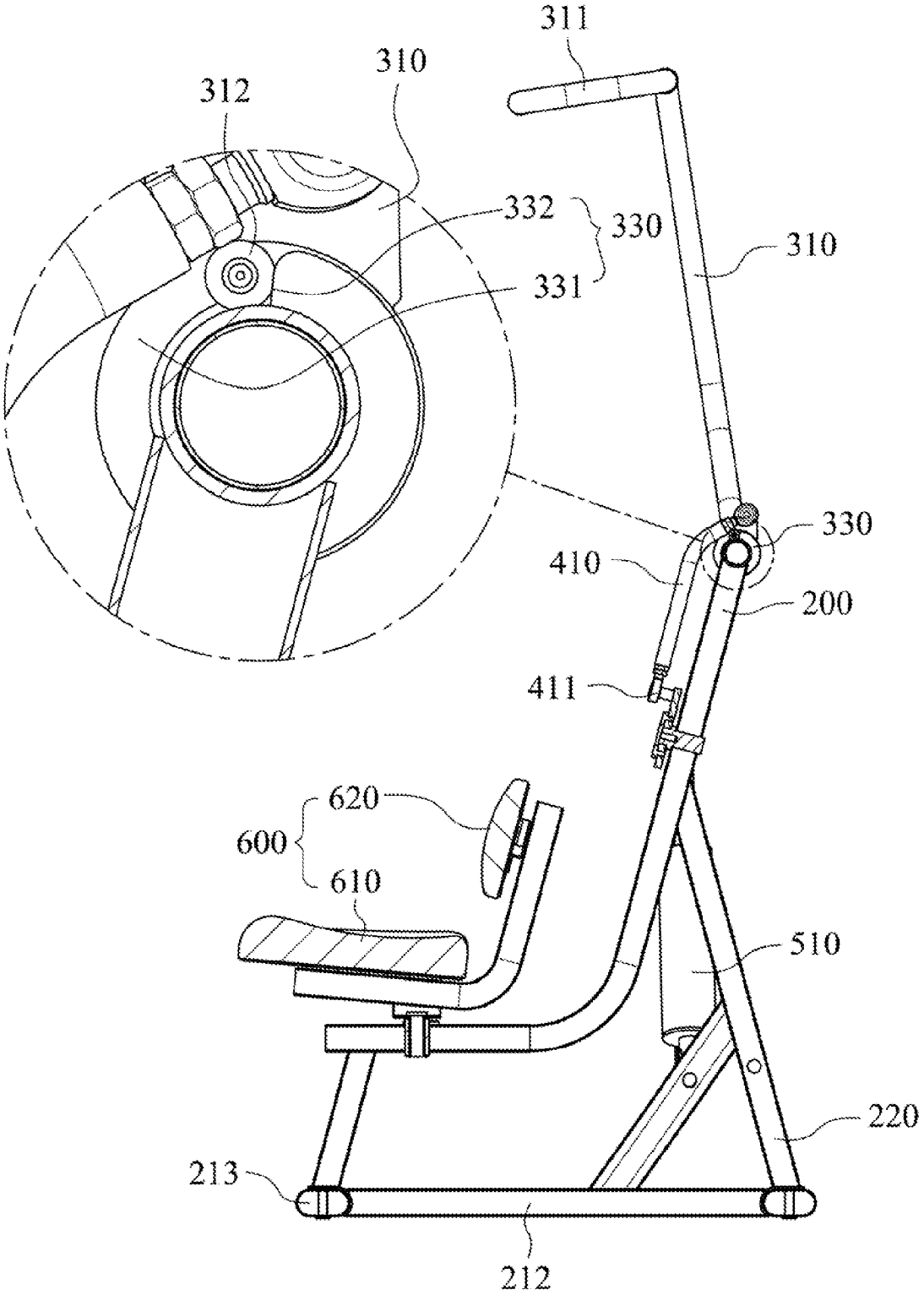
FIG. 5B shows a cross-sectional view along line B-B of FIG. 3.
Figure 5C:
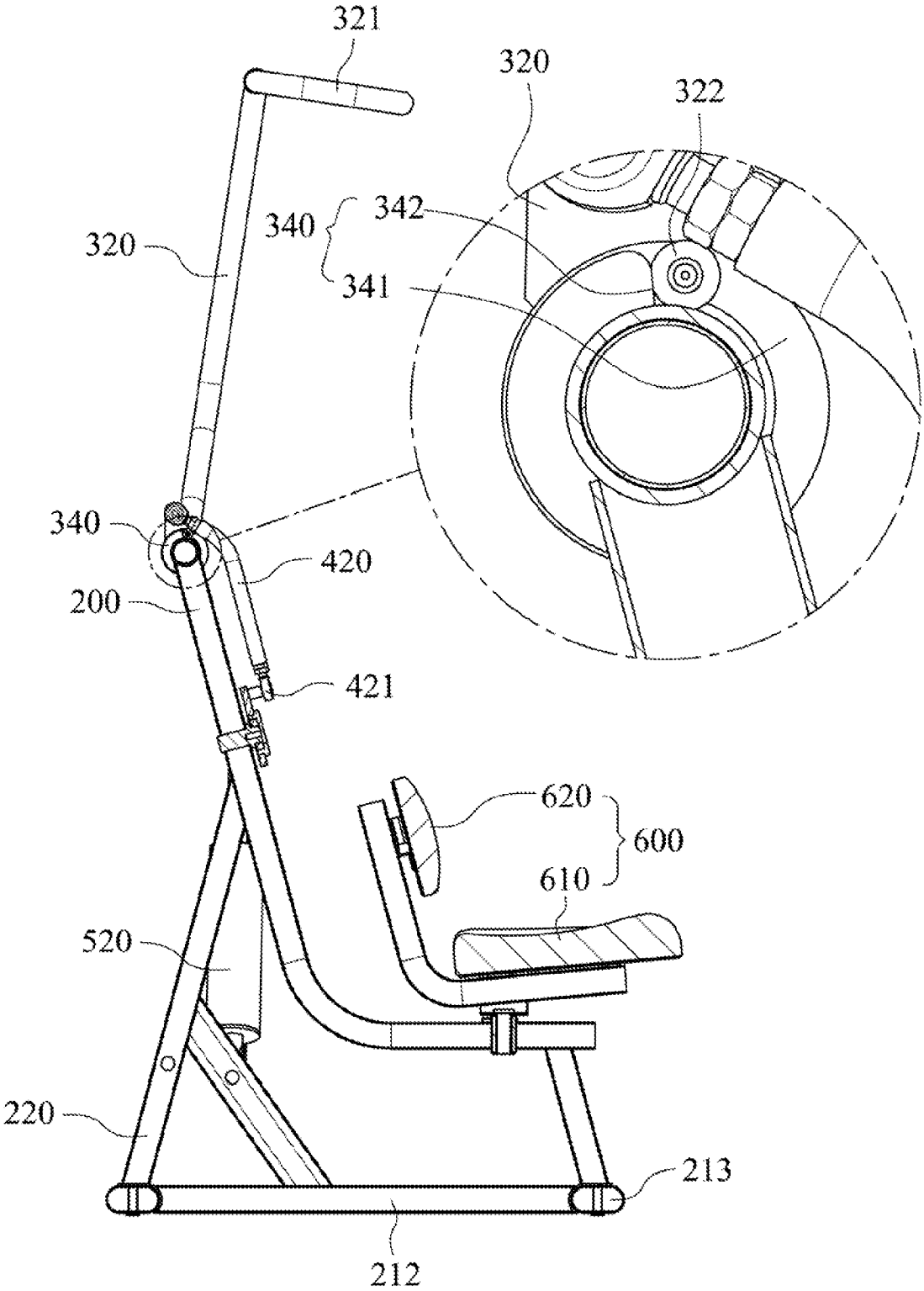
FIG. 5C shows a cross-sectional view along line C-C of FIG. 4.

For avoiding the excessive swinging angle of the first rotating arm 310 and the second rotating arm 320, the rehabilitation equipment 100 of the embodiment of FIG. 1 can further include a first angle restricting mechanism and a second angle restricting mechanism (not be labelled), wherein the first angle restricting mechanism for restricting an rotating angle of the first rotating arm 310, and the second angle restricting mechanism for restricting an rotating angle of the second rotating arm 320. FIG. 5A shows a cross-sectional view along line A-A of FIG. 2. FIG. 5B shows a cross-sectional view along line B-B of FIG. 3. FIG. 5C shows a cross-sectional view along line C-C of FIG. 4. In FIGS. 5A, 58 and 5C, the first angle restricting mechanism includes a first restricting rail 331 and a first sliding portion 312, and the second angle restricting mechanism includes a second restricting rail 341 and a second sliding portion 322, wherein the first restricting rail 331 has a first stop end 332, the second restricting rail 341 has a second stop end 342, the first sliding portion 312 is protruded from an end of the first pivoting unit 330 which is connected to the first rotating arm 310, the second sliding portion 322 is protruded from an end of the second pivoting unit 340 which is connected to the second rotating arm 320. The first sliding portion 312 is slidably located in the first restricting rail 331, wherein the first stop end 332 is for stopping the first sliding portion 312. The second sliding portion 322 is slidably located in the second restricting rail 341, wherein the second stop end 342 is for stopping the second sliding portion 322. Therefore, the swinging angles of the first rotating arm 310 and the second rotating arm 320 can be restricted.

Hence, the rehabilitation equipment 100 has the first restricting rail 331, the second restricting rail 341 with the first stop end 332 and the second stop end 342 which are restricted in the first sliding portion 312 and the second sliding portion 322, so that the injury of the user can be avoided by restricting the swinging angle of the rotating mechanism 300, and the excessive swinging angle of the third linking member 430 can also be avoided for preventing the damage of the elements.

Figure 6A:
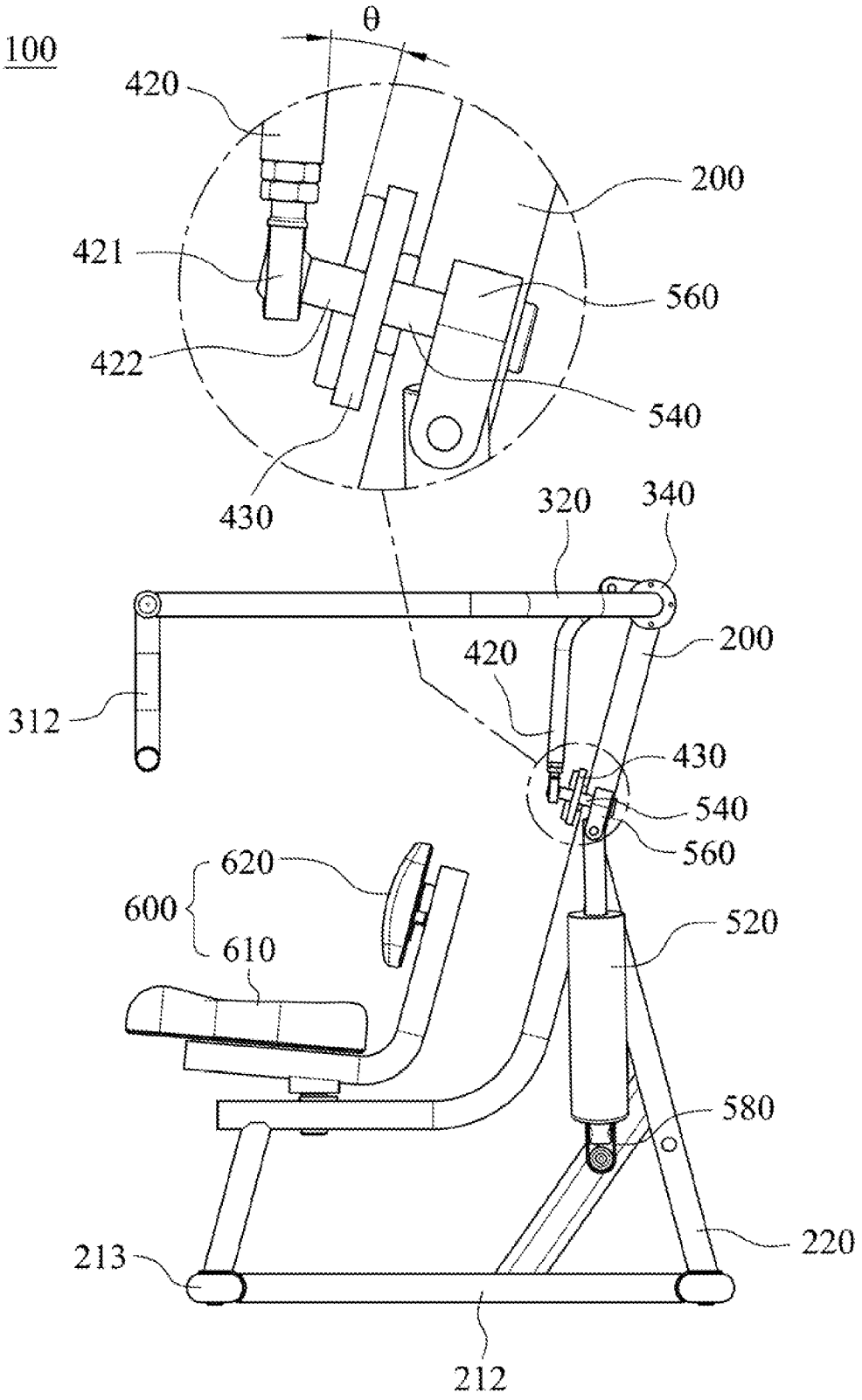
FIG. 6A shows a side view of the rehabilitation equipment of FIG.
Figure 6B:
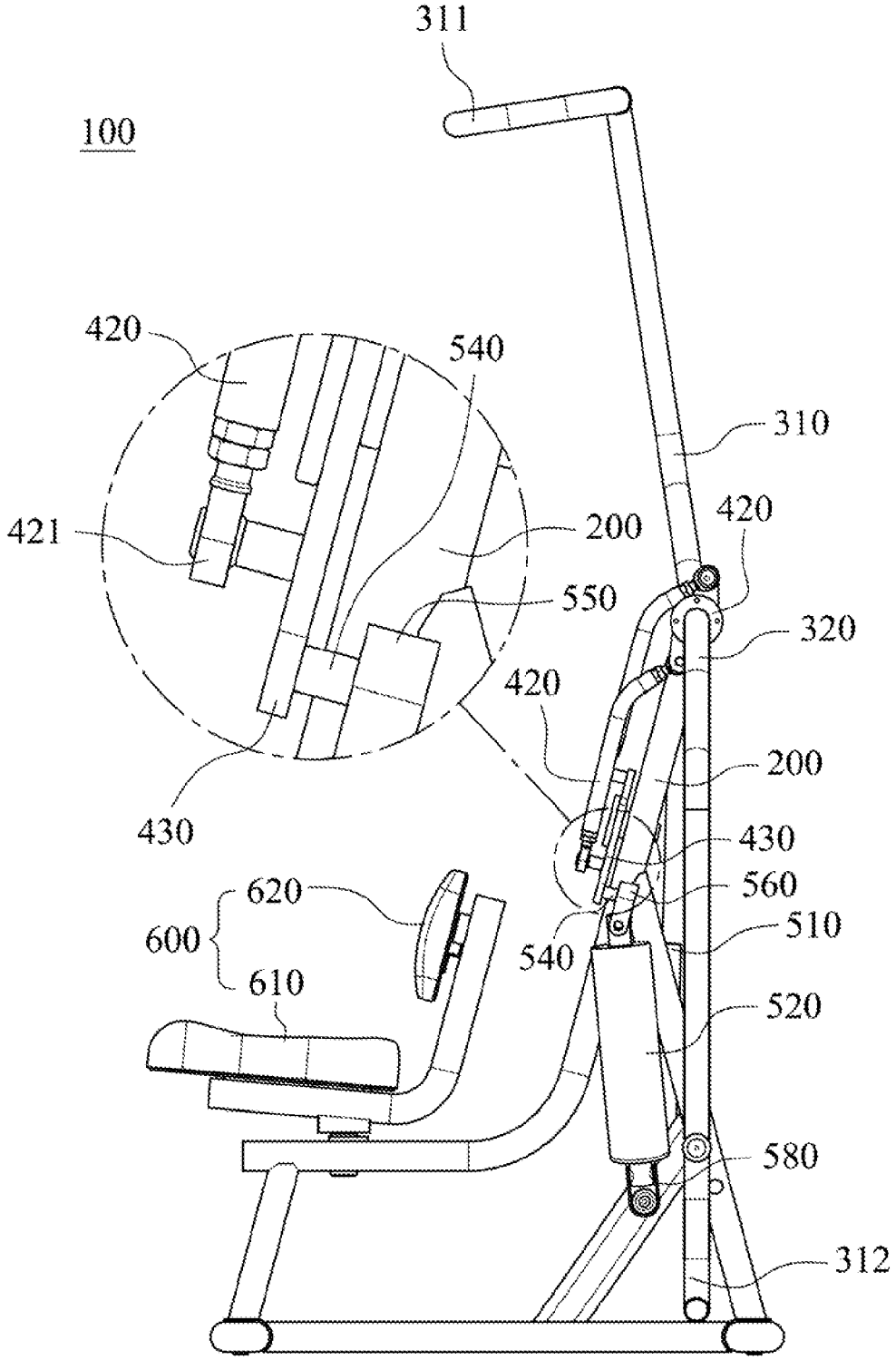
FIG. 6B shows a side view of an using state of the rehabilitation equipment of FIG. 3.

FIG. 6A shows a side view of the rehabilitation equipment 100 of FIG. 1. FIG. 6B shows a side view of an using state of the rehabilitation equipment 100 of FIG. 3. In FIGS. 1, 6A and 6B, for stably linking up the third linking member 430 by the first linking member 410 and the second linking member 420, the rehabilitation equipment 400 can further include two universal joints 411, 412, a first connecting shaft 412 and a second connecting shaft 422. The first connecting shaft 412 and the second connecting shaft 422 are connected to and passed' through the first region 432 and the second region 433 of the third linking member 430, respectively. The universal joints 411, 412 are connected to one end of the first connecting shaft 412 and one end of the second connecting shaft 422 respectively, so that the first linking member 410 and the second linking member 420 can be pivotally connected to the first region 432 and the second region 433. Therefore, the first linking member 410 and the second linking member 420 not only can be pivoted and swung relative to the third linking member 430, an angle θ between the third linking member 430 and the first linking member 410, and the third linking member 430 and the second linking member 420 also can provided respectively during using, wherein the angle θ is between 0 degrees and 30 degrees. Therefore, the pivoting and linking between the third linking member 430 and the first linking member 410, and the third linking member 430 and the second linking member 420 are smoother, and the damage and the abrasion between the components can be avoided.

In FIG. 2, the resistance mechanism 500 further includes a first connecting member 530, a second connecting member 540 and two universal joints 550, 560, wherein the first connecting member 530 is for pivotally connecting the first resistance member 510 to the third linking member 430, and one end of the first connecting member 530 is pivotally connected to the universal joint 550. The second connecting member 540 is for pivotally connecting the second resistance member 520 to the third linking member 430, and one end of the second connecting member 540 is pivotally connected to the universal joint 560. In detail, one end of the first connecting member 530 is pivotally connected to the first region 432, the other end of the first connecting member 530 is pivotally connected to the first resistance member 510 via the universal joint 550, one end of the second connecting member 540 is pivotally connected to the second region 433, the other end of the second connecting member 540 is pivotally connected to the second resistance member 520 via the universal joint 560. When the first resistance member 510 and the second resistance member 520 can be directly linked up with the third linking member 430, the components would be damaged easily, or led the noise. Hence, in this embodiment of the present disclosure, the first resistance member 510 and the second resistance member 520 are indirectly linked up the first resistance member 510 and the second resistance member 520 via the universal joints 550, 560, so that the damage of the components and the noise can be avoided.

Furthermore, the first resistance member 510 and the second resistance member 520 of the resistance mechanism 500 not only can be pivotally connected to the main frame 200 directly, but also can be pivotally connected to the cross frame shaft 211 of the main frame 200 via the universal joints 570, 580, respectively. Therefore, when the first resistance member 510 and the second resistance member 520 are forced for providing the telescopic motion to generate the resistance, the first resistance member 510 and the second resistance member 520 can be pivoted relative to the main frame 200, so that the rehabilitation equipment can be stably operated.

Figure 7:
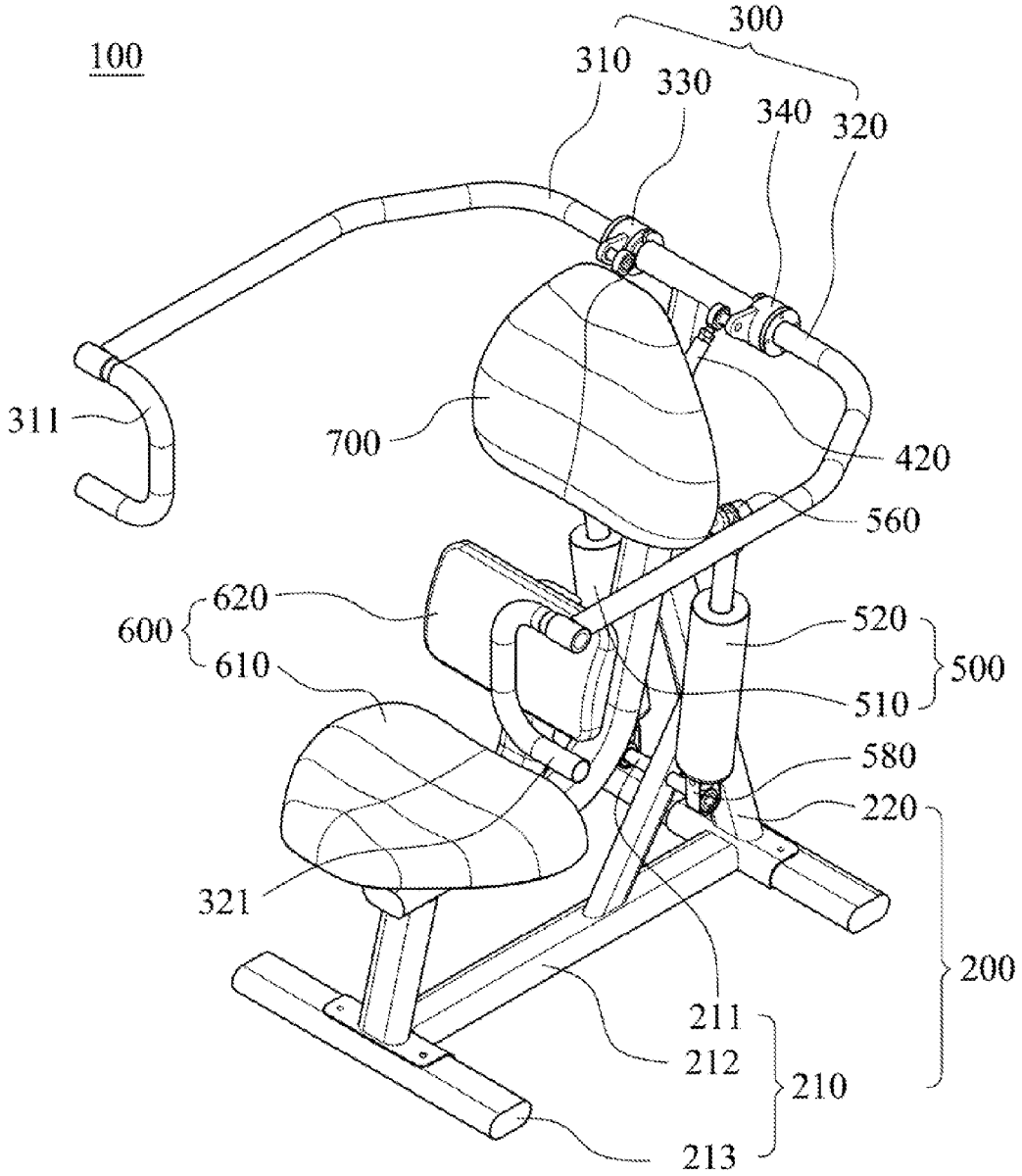
FIG. 7 shows a schematic view of the rehabilitation equipment which includes a headrest cushion of the FIG. 1.

FIG. 7 shows a schematic view of the rehabilitation equipment 100 which includes a headrest cushion 700 of the FIG. 1. In FIG. 7, the rehabilitation equipment 100 further includes a headrest cushion 700 connected to the supporting frame 220 of the main frame 200. Therefore, the user's head and back can lean against the back cushion 620 and the headrest cushion 700, so that the comfort and the safety can be increased during using.

It will be apparent to those skilled in the art that various modifications and variations can be made to the structure of the present disclosure without departing from the scope or spirit of the disclosure. In view of the foregoing, it is intended that the present disclosure cover modifications and variations of this invention provided they fall within the scope of the following claims.

What is claimed is:

1. A rehabilitation equipment, comprising:

a main frame;

a rotating mechanism disposed on the plain frame, and comprising:

a first rotating arm; and a second rotating arm, wherein the first rotating arm and the second rotating arm are pivotally connected to two sides of the main frame, respectively;

a linking mechanism linked up with the rotating mechanism, and comprising:

a first linking member linked up with the first rotating arm;

a second linking member linked up with the second rotating arm, wherein the first linking member and the second linking member are reciprocally and reversely linked up to each other; and a third linking member pivotally connected to the main frame, and having a first region and a second region, wherein the first linking member is pivotally connected to the first region, the second linking member is pivotally connected to the second region, thus the third linking member is reciprocally swung by the first linking member and the second linking member; and a resistance mechanism for providing a resistance, comprising:

a first resistance member; and a second resistance member, wherein a first end of the first resistance member and a first end of the second resistance member are pivotally connected to the main frame respectively, and a second end of the first resistance member and a second end of the second resistance member are pivotally connected to the first region and the second region of the third linking member respectively.

2. The rehabilitation equipment of claim 1, wherein the third linking member comprises:

a central connecting axis for pivotally connecting a center of the third linking member to the main frame.

3. The rehabilitation equipment of claim 1, wherein the first linking member and the second linking member are pivotally connected to a first side of the third linking member, and the first resistance member and the second resistance member are pivotally connected to a second side of the third linking member.

4. The rehabilitation equipment of claim 1, further comprising:

a first connecting shaft connected to and passed through the first region of the third linking member, and a first end of the first connecting shaft pivotally connected to the first linking member; and a second connecting shaft connected to and passed through the second region of the third linking member, and a first end of the second connecting shaft pivotally connected to the second linking member.

5. The rehabilitation equipment of claim 4, wherein the linking mechanism further comprises:

two universal joints, wherein the first end of the first connecting shaft and the first end of the second connecting shaft are pivotally connected to the first linking member and the second linking member via the universal joints, respectively.

6. The rehabilitation equipment of claim 1, further comprising:

a seat disposed on the main frame.

7. The rehabilitation equipment of claim 1, wherein the resistance mechanism further comprises:

a first connecting member for pivotally connecting the first resistance member to the first region of the third linking member; and a second connecting member for pivotally connecting the second resistance member to the second region of the third linking member.

8. The rehabilitation equipment of claim 7, wherein the resistance mechanism further comprises:

two universal joints, wherein the first connecting member and the second connecting member are pivotally connected to the second end of the first resistance member and the second end of the second resistance member via the universal joints, respectively.

9. The rehabilitation equipment of claim 1, wherein each of the first end of the first resistance member and the first end of the second resistance member is pivotally connected to the main frame via an universal joint.

10. The rehabilitation equipment of claim 1, wherein the first resistance member and the second resistance member are oil cylinders, pneumatic cylinders or magnetic resistance mechanism.

11. A rehabilitation equipment, comprising:

a main frame;

a first rotating arm;

a second rotating arm;

a first pivoting unit for pivotally connecting the first rotating arm to a first side of the main frame;

second pivoting unit for pivotally connecting the second rotating arm to a second side of the main frame;

a first linking member connected to the first pivoting unit for linking up with the first rotating arm;

a second linking member connected to the second pivoting unit for linking up with the second rotating arm, wherein the first linking member and the second linking member are reciprocally and reversely linked up to each other;

a third linking member pivotally connected to the main frame, and having a fiat region and a second region, wherein the first linking member is pivotally connected to the first region, the second linking member is pivotally connected to the second region, thus the third linking member is reciprocally swung by the first linking member and the second linking member;

a first resistance member, a first end of the first resistance member connected to the main frame, a second end of the first resistance member pivotally connected to the first region of the third linking member;

a second resistance member, a first end of the second resistance member connected to the main frame, a second end of the second resistance member pivotally connected to the second region of the third linking member; and a seat rotatably disposed on the main frame.

12. The rehabilitation equipment of claim 11, further comprising:

a first angle restricting mechanism for restricting an rotating angle of the first rotating arm; and a second angle restricting mechanism for restricting an rotating angle of the second rotating arm.

13. The rehabilitation equipment of claim 12, wherein the first angle restricting mechanism comprises:

a first restricting rail located in the first pivoting unit, and having a first stop end; and a first sliding portion protruded from an end of the first pivoting unit which is connected to the first rotating arm, and slidably located in the first restricting rail, wherein the first stop end is for stopping the first sliding portion.

14. The rehabilitation equipment of claim 12, wherein the second angle restricting mechanism comprises:

a second restricting rail located in the second pivoting unit, and having a second stop end; and a second sliding portion protruded from an end of the second pivoting unit which is connected to the second rotating arm, and slidably located in the second restricting rail, wherein the second stop end is for stopping the second sliding portion.

15. The rehabilitation equipment of claim 11, further comprising:

a first connecting shaft connected to and passed through the first region of the third linking member;

a second connecting shaft connected to and passed through the second region of the third linking member; and two universal joints, wherein a first end of the first connecting shaft and a first end of the second connecting shaft are pivotally connected to the first linking member and the second linking member via the universal joints, respectively.

16. The rehabilitation equipment of claim 11, further comprising:

a first connecting member for pivotally connecting the first resistance member to the third linking member; and a second connecting member for pivotally connecting the second resistance member to the third linking member.

17. The rehabilitation equipment of claim 11, wherein each of the first end of the first resistance member and the first end of the second resistance member is pivotally connected to the main frame via a universal joint.

18. The rehabilitation equipment of claim 17, wherein the first resistance member further comprises:

a universal joint pivotally connected the second end of the first resistance member to the first connecting member.

19. The rehabilitation equipment of claim 17, wherein the second resistance member further comprises:

a universal joint pivotally connected the second end of the second resistance member to the second connecting member.

20. The rehabilitation equipment of claim 11, wherein the first resistance member and the second resistance member are oil cylinders, pneumatic cylinder or magnetic resistance mechanism.

* * * * *